United States Patent [19]

Ashford

[11] Patent Number: 4,660,596

[45] Date of Patent: Apr. 28, 1987

[54] INSIDE B.O.P. VALVE

[76] Inventor: Ronald A. Ashford, 117 Avondale Dr., Lafayette, La. 70506

[21] Appl. No.: 898,039

[22] Filed: Aug. 19, 1986

[51] Int. Cl.[4] ..... F16K 5/06

[52] U.S. Cl. ..... 137/496; 175/318

[58] Field of Search ..... 137/494, 496; 175/318; 166/321, 325

[56] References Cited

U.S. PATENT DOCUMENTS

| | | | |
|---|---|---|---|
| 3,200,837 | 8/1965 | Brown | 137/496 |
| 3,433,252 | 3/1969 | Kennard | 137/496 |
| 3,783,942 | 1/1974 | Mott | 175/318 X |

*Primary Examiner*—Robert G. Nilson

*Attorney, Agent, or Firm*—Harvey B. Jacobson

[57] ABSTRACT

The invention comprises an elongated housing having a valve body reciprocal therein between predetermined limits of oscillation and the valve body includes a spherical valve member automatically shiftable between open and closed positions as the valve body is shifted between its limit positions. A tubular plug is provided and may be used to lock the tubular valve member in the open position and the valve body is yieldingly urged to the limit position in which the valve member is in the closed position. The valve body, however, is constructed in a manner whereby fluid flow through the housing in a first direction above a predetermined velocity will maintain the valve body in the other limit position with the valve member in its open position.

11 Claims, 5 Drawing Figures

INSIDE B.O.P. VALVE

BACKGROUND OF THE INVENTION

1. Field of the Invention

This invention relates to oil and gas well drilling and safety valves used in oil and gas well drilling. More specifically, the instant invention resides in the provision of an inside blowout preventer valve which is automatically closed as a result of a reduction of the velocity of drilling fluid moving downwardly therethrough and which may be plugged while in the open position through the utilization of a plug retrievable by an overshot tool.

2. Description of Related Art

Various different forms of inside blowout preventer valves and kelly valves including some of the general structural and operational features of the instant invention heretofore have been provided.

Examples of these different forms of previously known valves are disclosed in U.S. Pat. Nos. 3,086,764, 3,292,718, 3,750,751, 3,763,940, 3,768,506, 3,901,321, 3,915,228, 4,086,935, 4,262,693, 4,303,100, 4,316,596, 4,361,188, 4,467,870, 4,475,598, 4,519,576, 4,550,780, 4,552,219 and 4,569,397.

However, the blowout preventer valve of the instant invention constitutes a non-complex valve which is fully operative in the intended manner and which defines a large diameter passage therethrough, when open, to thereby provide minimum resistance to drilling fluid passing therethrough.

SUMMARY OF THE INVENTION

The blowout preventer valve of the instant invention, in its most comprehensive form, includes only four major components and may be constructed in a somewhat simplified form incorporating only three major components in addition to various sealing rings, a compression spring and an actuator pin.

The main object of this invention is to provide a simplified form of inside blowout preventer valve which is fully operative to perform the intended function and yet which is of non-complex construction and therefore considerably less expensive than conventional inside blowout preventer valves.

Another object of this invention is to provide a blowout preventer including structural features thereof which coact to provide dependable operation over an extended lifetime.

Yet another important object of this invention is to provide an inside blowout preventer valve which may be readily plugged in the open position.

A final object of this invention to be specifically enumerated herein is to provide an inside blowout preventer valve constructed in accordance with the previous objects and which will conform to conventional forms of manufacture, be of simple construction and trouble free in operation so as to provide a device that will be economically feasible, long lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
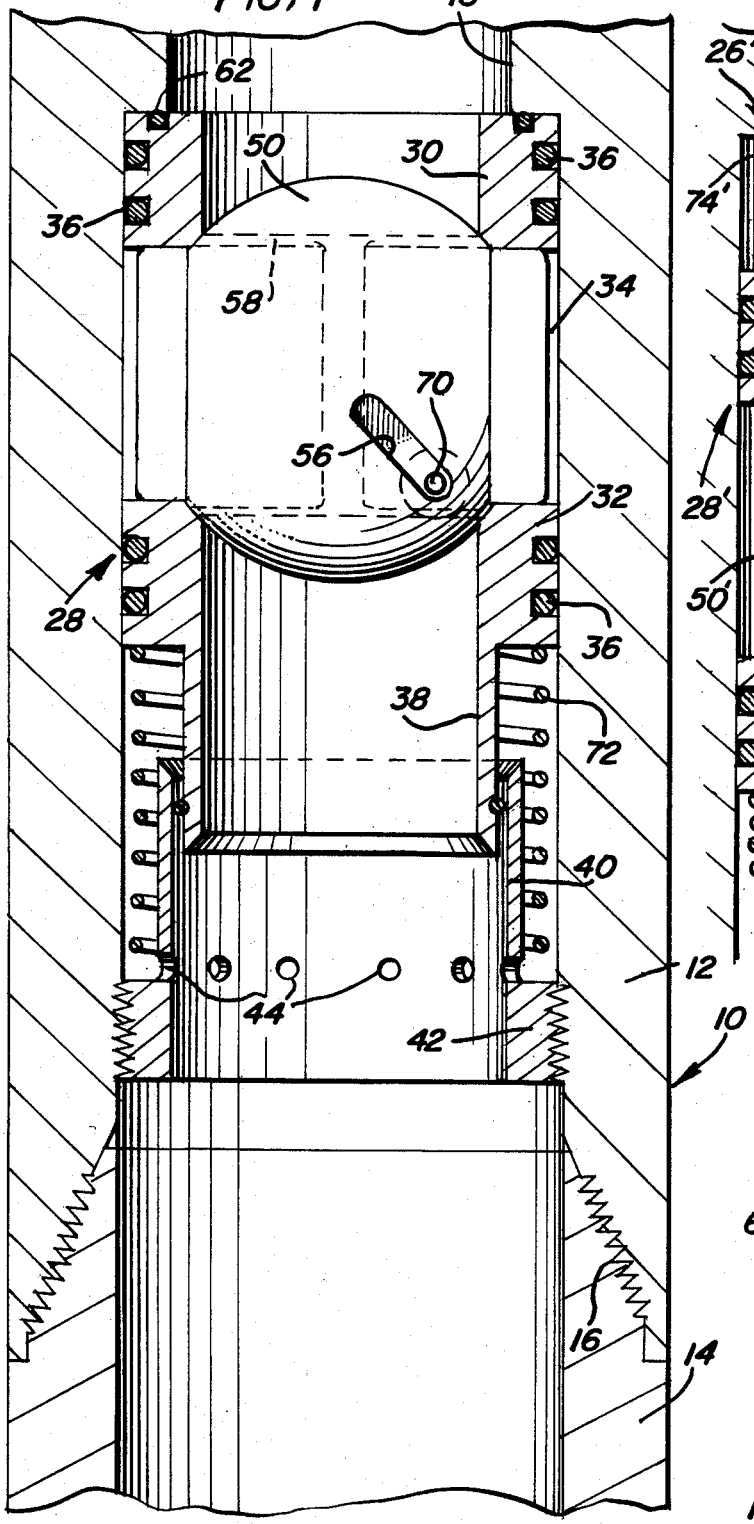
FIG. 1 is a vertical sectional view through a section of drill string tubing with the blowout preventer of the instant invention mounted within the lower end portion of one of the tubing sections and with the valve in a closed position.

Referring now more specifically to the drawings, the numeral 10 generally designates a tubing string including vertically adjacent upper and lower tubing string sections 12 and 14 threadedly engaged with each other as at 16. The upper tubing string section 12 includes a longitudinal bore 18 formed therethrough including a lower end diametrically enlarged counterbore 20. The upper end of the counterbore is smooth as at 22 and the lower end of the counterbore is threaded as at 24.

An inside blowout preventer valve mechanism 26 is disposed within the counterbore 20 and includes an elongated tubular valve body referred to in general by the reference numeral 28 incorporating first and second upper and lower end portions 30 and 32 interconnected by peripherally spaced connecting bars 34 extending between and operatively connecting the axially spaced end portions 30 and 32. The end portions 30 and 32 each include axially spaced circumferential sealing rings 36 for forming a sliding seal with the counterbore 20 and the lower end of the end portion 32 includes a diametrically reduced tubular neck 38 telescoped downwardly into an upwardly projecting integral tubular nipple 40 carried by an externally threaded abutment ring 42 threaded into the lower end of the counterbore 20. The tubular nipple 40 is of smaller outside diameter than the abutment ring 42 and includes an inside diameter substantially equal to the inside diameter of the abutment ring 42. The lower end of the tubular nipple 40 includes peripherally spaced relief openings 44 formed radially therethrough and the lower end of the tubular neck includes circumferential groove 46 in which an O-ring 48 is seated in sliding sealing contact with the inner surfaces of the tubular nipple 40 to form a fluid-tight seal therewith.

A partial spherical valve member 50 is provided and is disposed captive between annular seats 52 and 54 defined on the adjacent ends of the end portions 30 and 32. The external surfaces of the valve member 50 are slidably engaged with the seats 52 and 54 and the exterior of the valve member 50 includes a groove 56 formed therein. In addition, the valve member 50 includes a generally diametric bore 58 extending therethrough of substantially the same diameter as the interiors of the end portions 30 and 32 and of slightly smaller diameter than the major diameter portions of the seats 52 and 54 whereby a substantially fluid-tight seal is defined between the external surfaces of the valve member 50 and the seats 52 and 54. The upper end of the end portion 30 includes a circumferential groove 60 in which an O-ring seal 62 is seated.

The upper tubular string section 12 includes a radial bore 64 formed therein including a diametrically enlarged outer end counterbore 66 and the counterbore 66 is threaded and includes a plug 68 removably threaded therein and equipped with an inner end pin portion 70 received through the bore 64 and slidably received in the slot or groove 56.

A compression spring 72 is disposed about tubular neck 38 and tubular nipple 40 and interposed between the ring 42 and the underside of the end portion 32 outwardly of the tubular neck 38. The compression spring 72 yieldingly biases the valve body 28 upwardly relative to the abutment ring 42 toward an upper limit position with the O-ring seal 62 tightly abutted against the downwardly facing shoulder 74 defined by the upper tubular string section 12 at the upper end of the counterbore 20. When in the upper limit position, the engagement of the pin portion 70 in the slot or groove 56 causes the valve member 50 to be angularly displaced to the position thereof illustrated in FIG. 1 with the diametric bore 58 disposed transverse to the longitudinal center axis of the valve body 28. Of course, in this position the valve member 50 is closed. On the other hand, when the valve body 28 is shifted downwardly toward the lower limit position thereof illustrated in FIG. 2, the coaction between the pin portion 70 and the slot or groove 56 causes the valve member 50 to rotate to a position with the diametric bore 58 substantially aligned and centered with the longitudinal center axis of the valve body 28. When the valve member 50 is in the position thereof illustrated in FIG. 2, it is in the open position allowing the free flow of drilling fluid downwardly through the tubing string 10 past the valve mechanism 26.

Figure 2:
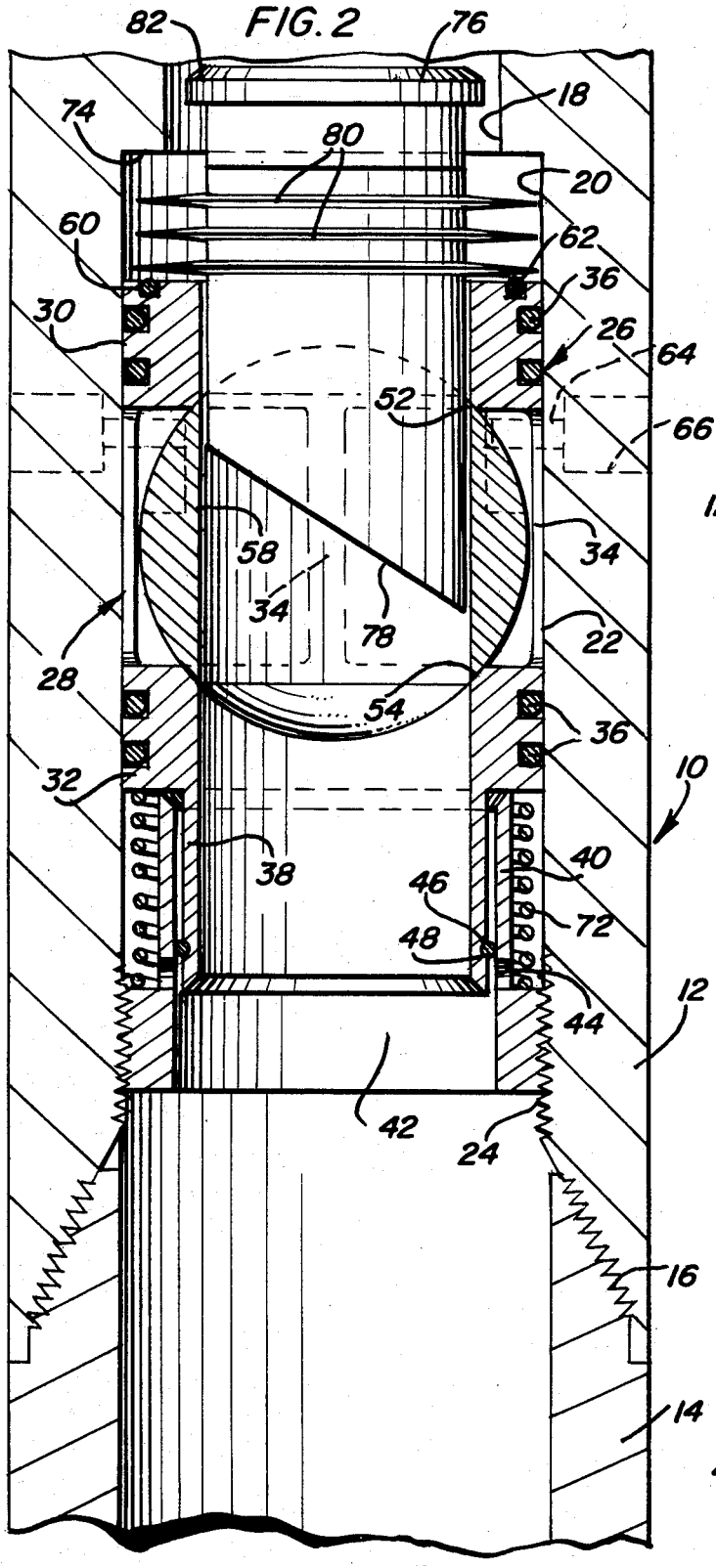
FIG. 2 is a vertical sectional view similar to FIG. 1 but illustrating the valve in an open position and having a wire line retrievable plug operatively associated therewith.
Figure 3:
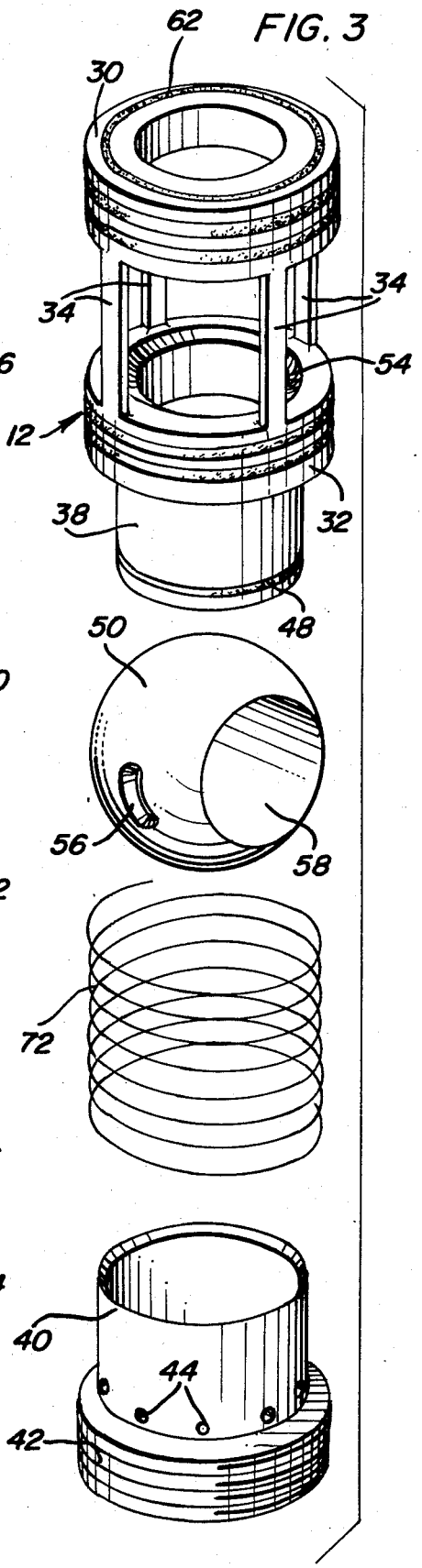
FIG. 3 is an exploded perspective view of the valve.

Inasmuch as the valve body 28 is continuously yieldingly biased toward the upper limit position thereof illustrated in FIG. 1 with the valve member 50 in the closed position, it may be seen that the valve member 50 will be automatically closed at any time the downward flow of drilling fluid through the tubular string 10 is decreased below a predetermined minimum velocity. Accordingly, should a kick occur through the tubing string, pressure protection is afforded the associated swivel, drilling hose, standpipe and mud pump inasmuch as the valve body 28 will be automatically upwardly shifted to the upper limit position thereof so as to close the valve member 50.

It will be noted that the inside diameter of the end portions 30 and 32 is less than the inside diameter of the longitudinal bore 18. Accordingly, as drilling fluid is pumped rapidly down through the tubing string 10, a downward force is exerted on the upper end of the upper end portion 30 of the valve body 28 to automatically maintain the valve body 28 in its lower position illustrated in FIG. 2 against the biasing action of the spring 72, thereby maintaining the valve member 50 open.

If it is desired to maintain the valve member 50 open when there is insufficient velocity of drilling fluid downward through the tubing string 10, a tubular plug 76 may be introduced into the tubing string 10 for movement downwardly therein while drilling fluid is passing downwardly through the valve mechanism 26 at or above the minimum velocity required. With the valve member 50 thus maintained in the open position illustrated in FIG. 2, the lower end of the plug 76 extends into the diametric bore 58 and thus maintains the valve member 50 in the open position, thereby preventing upward movement of the valve body 28 to its uppermost limit position. The lower end of the plug 76 is bevelled as at 78 and the upper end thereof includes axially spaced circumferentially extending resilient radially outwardly projecting flanges or rings 80 for sealed engagement with the longitudinal bore 18. However, when the valve body 28 is in the lower position thereof illustrated in FIG. 2, the flanges 80 are receivable within the counterbore 20 above the end portion 30 and below the shoulder 74. In addition, the upper end of the plug 76 includes a diametrically enlarged head 82 engageable by a wire line supported overshot tool for upward removal of the plug 76 through the tubing string 10, when desired.

Figure 5:
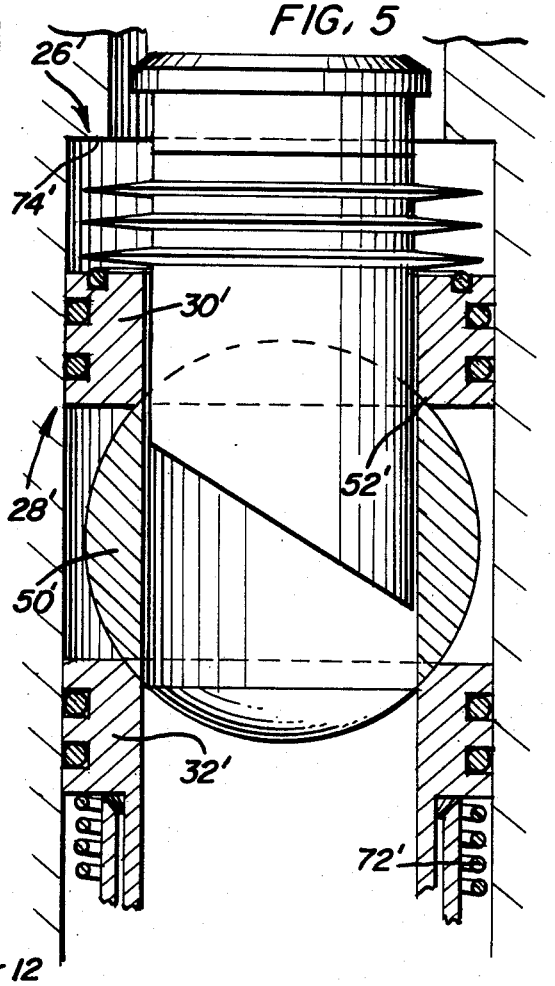
FIG. 5 is a vertical sectional view similar to FIG. 2 illustrating a modified form of valve including a two-piece valve body.
Figure 4:
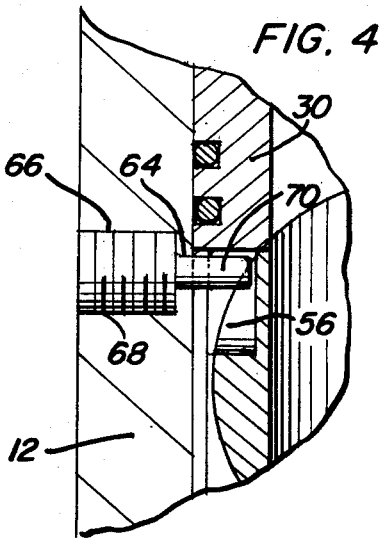
FIG. 4 is a fragmentary enlarged vertical sectional view illustrating the coaction between the valve member actuator pin and the valve member for opening and closing the valve member.

With attention now directed more specifically to FIG. 5 of the drawings, there may be seen a modified form of valve mechanism referred to in general by the reference numeral 26'. The valve mechanism 26' is substantially identical to the valve mechanism 26 except that the valve body 28' of the valve mechanism 26' comprises separate end portions 30' and 32' corresponding to the end portions 30 and 32 and which are not interconnected by bars corresponding to the bars 30. Nevertheless, the upward thrust on the end portion 32' by the compression spring 72' corresponding to the compression spring 72 urges the valve member 50' upwardly into tight seated engagement with the annular seat 52' of the end portion 30' and thus also yieldingly biases the end portion 30' upwardly toward the shoulder 74' corresponding to the shoulder 74.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A safety valve mechanism for use in a drill string, said mechanism including an elongated housing incorporating first and second ends and defining a longitudinal bore extending therethrough, one end of said bore including a diametrically enlarged counterbore opening endwise outwardly of said first end, said housing including means defining abutment shoulder means at the inner end portion of said counterbore, elongated, tubular valve body means defining a central bore extending longitudinally therethrough sealingly and slidingly telescoped into said counterbore and including a first end portion sealingly abuttingly engageable with said abutment shoulder means and a second end portion facing outwardly of said first end, said first and second end portions defining annular seats spaced apart axially of said bore and opposing each other, a partial spherical valve member disposed in said bore between and slidably seated against said seats and including a generally diametric bore extending therethrough, abutment means in said counterbore on the side of said valve body means remote from said abutment shoulder means, spring means disposed in said counterbore operatively connected between said abutment means and valve body means second end portion yieldingly biasing said valve body means toward abutting engagement with said abutment shoulder means, said valve body means being shiftable in said counterbore between a first limit position defined by said abutment shoulder means and a second limit position displaced axially along said counterbore from said abutment shoulder means, and coacting valve position shifting means carried by said valve member and housing operative to automatically shift said valve member between open and closed positions upon shifting of said valve body means to said second and first positions, respectively, said diametric bore extending longitudinally of said valve body means and being registered with said central bore when said valve member is in said open position and being disposed generally normal to said central bore when said valve member is in said closed position, said valve body means central bore being smaller in diameter than said longitudinal bore.

2. The mechanism of claim 1 wherein said spring means includes coiled compression spring means interposed between said valve body means second end and said abutment means.

3. The mechanism of claim 1 wherein said valve body means first and second end portions are fixed relative to each other.

4. The mechanism of claim 1 wherein said valve body means first and second end portions comprise separate axially spaced sleeve members slidingly and sealing disposed in said longitudinal bore and said annular seats are defined on the adjacent ends of said sleeve members.

5. The mechanism of claim 1 including an elongated tubular plug body having opposite ends and including one end loosely receivable within said longitudinal bore and closely receivable within said first end portion and at least the adjacent end of said diametric bore when said valve member is in the open position, the other end of said plug including axially spaced generally radially outwardly projecting and circumferentially extending resilient flanges thereon receivable through said longitudinal bore and of generally the same diameter as said counterbore, the axial extent of said flanges, collectively, along said plug body being less than the axial extent of shifting of said valve body means between said limit positions, the other end of said plug body including means operatively engageable by an overshot tool for axial withdrawal of said plug body from said longitudinal bore and counterbore.

6. The mechanism of claim 5 wherein said one end of said plug body is bevelled.

7. The mechanism of claim 1 wherein said second end portion of said valve body includes a diametrically reduced tubular neck, said abutment means including a tubular nipple of greater inside diameter than the outside diameter of said tubular neck, said tubular neck and nipple being telescopically engaged, said spring means including coiled compression spring means disposed about said tubular nipple and interposed between said valve body means second end and said abutment means.

8. The mechanism of claim 7 wherein said valve body means first and second end portions are fixed relative to each other.

9. The mechanism of claim 7 wherein said valve body means first and second end portions comprise separate axially spaced sleeve members slidingly and sealing disposed in said longitudinal bore and said annular seats are defined on the adjacent ends of said sleeve members.

10. The mechanism of claim 7 including an elongated tubular plug body having opposite ends and including one end loosely receivable within said longitudinal bore and closely receivable within said first end portion and at least the adjacent end of said diametric bore when said valve member is in the open position, the other end of said plug including axially spaced generally radially outwardly projecting and circumferentially extending resilient flanges thereon receivable through said longitudinal bore and of generally the same diameter as said counterbore, the axial extent of said flanges, collectively, along said plug body being less than the axial extent of shifting of said valve body means between said limit positions, the other end of said plug body including means operatively engageable by an overshot tool for axial withdrawal of said plug body from said longitudinal bore and counterbore.

11. The mechanism of claim 1 wherein said first end of said valve body includes axially facing annular seal means sealingly engageable with said abutment shoulder means when said valve body means is in said first limit position thereof.

* * * * *